US005280753A

United States Patent [19]

Kavanagh et al.

[11] Patent Number: 5,280,753

[45] Date of Patent: Jan. 25, 1994

[54] VARIABLE HEIGHT TABLE

[76] Inventors: Gerald Kavanagh; Michael Kavanagh, both of 75 Tobago Street, Glasgow, United Kingdom

[21] Appl. No.: 655,386

[22] PCT Filed: Aug. 10, 1989

[86] PCT No.: PCT/GB89/00916

§ 371 Date: Mar. 26, 1991

§ 102(e) Date: Mar. 26, 1991

[87] PCT Pub. No.: WO90/01282

PCT Pub. Date: Feb. 22, 1990

[30] Foreign Application Priority Data

Aug. 11, 1988 [GB] United Kingdom ..... 8819076.4
May 24, 1989 [GB] United Kingdom ..... 8911874.9

[51] Int. Cl.[5] ..... A47D 85/00
[52] U.S. Cl. ..... 108/12; 108/144
[58] Field of Search ..... 108/144, 145, 12, 11, 108/19

[56] References Cited

U.S. PATENT DOCUMENTS 928,726 7/1909 Witthaus ..... 108/12 X
2,544,229 3/1951 Hoppe .
2,582,791 1/1952 Page .
2,643,923 6/1953 Beall ..... 108/12
4,161,915 7/1979 Varmuza ..... 108/12 X
4,237,795 12/1980 Parker ..... 108/12
4,259,909 4/1981 Belina ..... 108/12

FOREIGN PATENT DOCUMENTS 908851 4/1946 France .
1130763 2/1957 France .
659265 10/1951 United Kingdom .

*Primary Examiner*—José V. Chen
*Attorney, Agent, or Firm*—Mason, Fenwick & Lawrence

[57] ABSTRACT

A dual mode table which is convertible to serve as a coffee table and as a dining table comprises a fixed structure supporting a table top through a pair of table top extension means. The extension means comprise facing swingable frames which are pivotally pinned to the base and engage the table top for example through a pin and slot connection for movement of the table top between lowered and raised positions. In the lowered position the table top is substantially at the level of the base structure while in the raised position the extension means are locked and stabilized by appropriate means.

16 Claims, 9 Drawing Sheets

VARIABLE HEIGHT TABLE

DESCRIPTION

The present invention relates to a piece of furniture and more especially to a table.

It is the principal object of the present invention to provide a dual mode table which in one mode has the table top at a relatively lower lever whereby the table can serve as a coffee table but which, for the second mode, can have the top conveniently raised to a higher level so that the table can be used satisfactorily as a dining table. U.S. Pat. No. 4,303,018 shows such a convertible dual-mode table but the mechanism in this patent for setting the table top in the raised and lowered conditions is relatively complex and the arrangement is not particularly suited for use with a table top of elongate rectangular form, being rather more intended for use with a circular table top.

According to the present invention there is provided a piece of furniture, expecially a table, comprising a fixed base structure, a work top, extension means located between the fixed base structure and the work top comprising swingable support members (11) which in said first position set the work top (3) substantially level with the top of the base structure (2) and at a first height (H1) above a floor datum (D-D) while in said second elevated position the work top (2) is set at an increased height (H2) above said first height (H1), said swingable support members (11) being pivotally connected to the fixed base structure (2) at pivot means (7, 23), stabilising means (12A) are provided to stablise the extension means (4) when the work top (3) is in said second relatively elevated position, characterised in that each swingable support member (11) comprises a double-arm lever (12/12A, 33/33A), one arm (12A, 33A) of each double-arm lever being in the form of a tail defining said stablising means, said tails (12A, 33A) of the swingable members (11) firmly engaging the fixed base structure (2) at points (8) spaced from said pivot means (7, 23) so as to stablise said support members (11) when the extension means (4) is in an extended condition, and in that releasable lock means (15B, 39) are provided for each swingable support member (11) to lock the support member in said second elevated position.

In a preferred embodiment the extension means comprises a pair of swingable support members which, adjacent one end, are pivotally attached to the base structure, the other end of each support member being slidably coupled to the work top by a pin-and-slot arrangement at the work top whereby the swingable support members can be swung from a lowered position whereat said work top occupies said first position to a raised position to place said work top in said second raised position.

Automatic locking means can be provided to automatically lock the extension means in the open extended condition.

Embodiments of the present invention will now be described by way of example with reference to the accompanying drawings wherein.

FIGS. 7(*a*)-7(*e*) show various stages in the raising operation of the table top.

FIGS. 8-11 show a further dual-mode table according to another embodiment of the present invention, FIGS. 8-11 exactly corresponding to FIGS. 1, 3, 4 and 6 respectively of the first embodiment.

Figure 1:
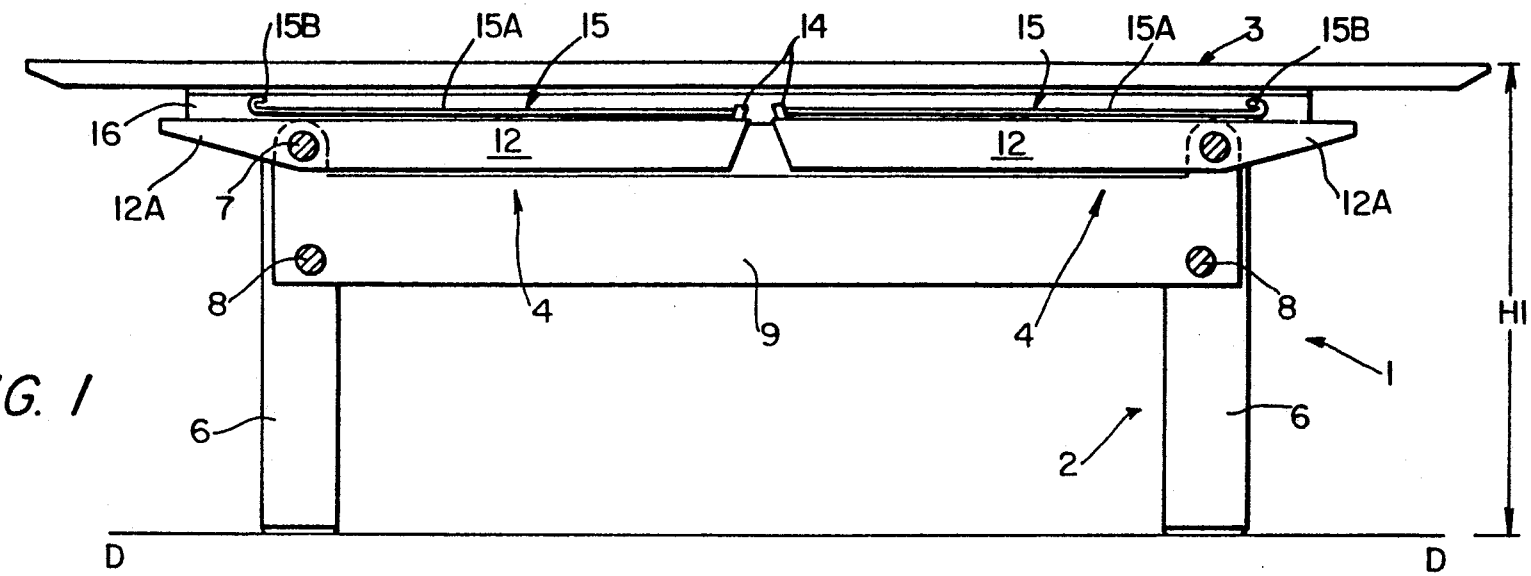
FIG. 1 is a side view of a dual mode table through section B—B in FIG. 2, in accordance with the present invention.
Figure 3:
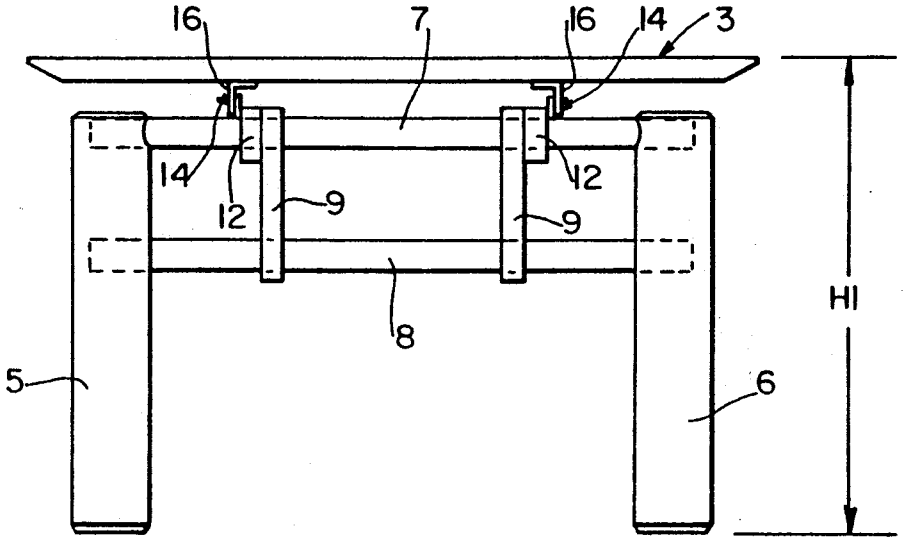
FIG. 3 shows an end view of the table of FIG. 1.
Figure 2:
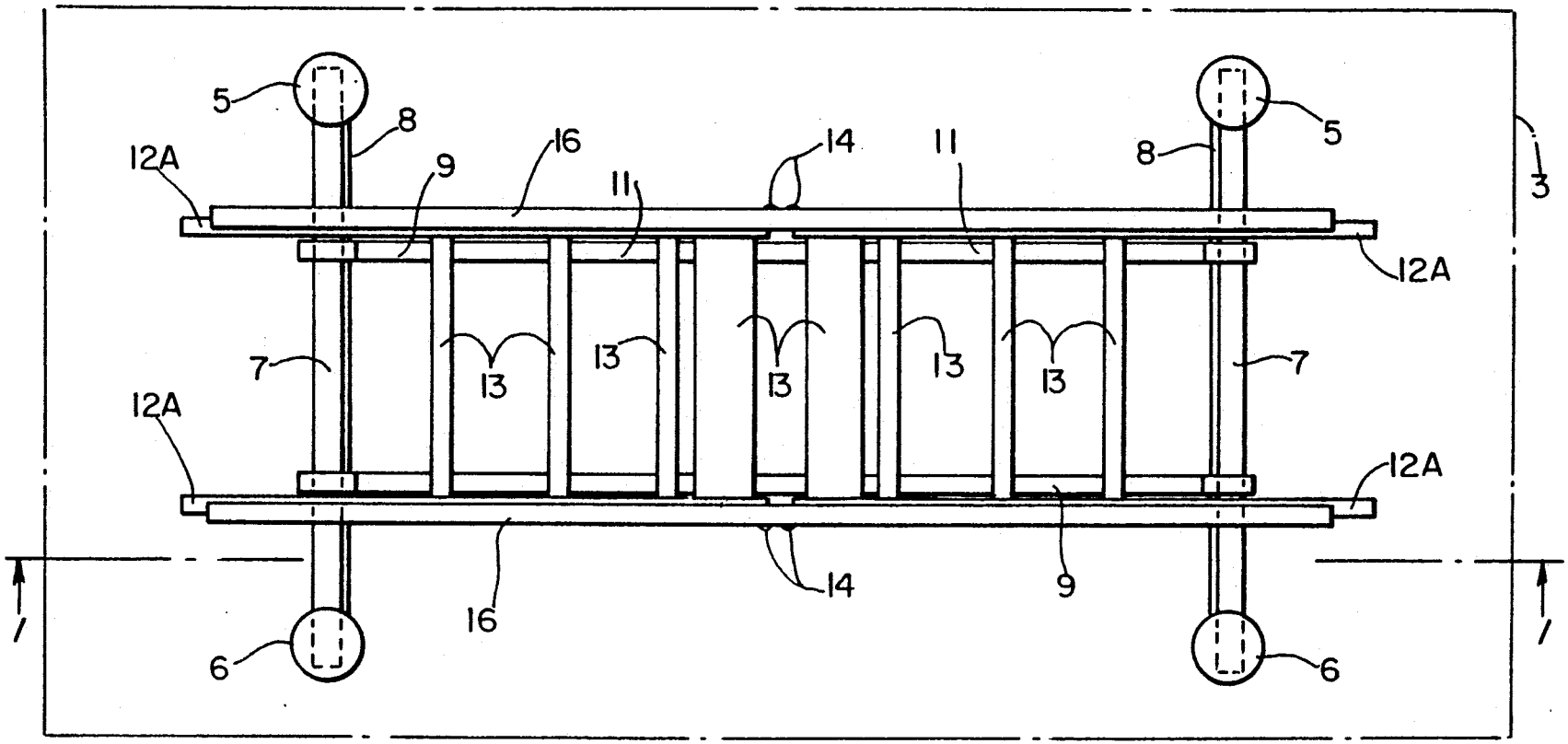
FIG. 2 is a plan view of the table of FIG. 1 with the table top "transparent" for better understanding of the operating mechanism.
Figure 4:
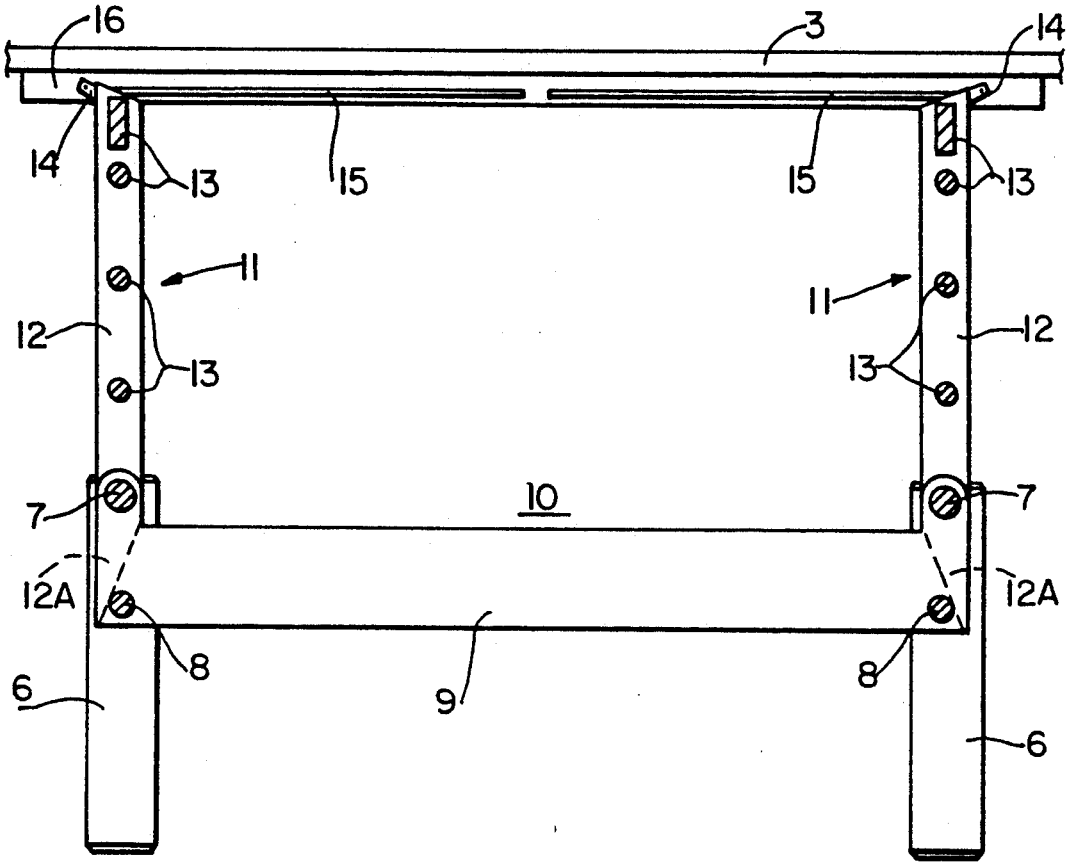
FIGS. 4, 5, 6 show similar views as FIGS. 1-3 respectively but with the table in the raised condition.
Figure 5:
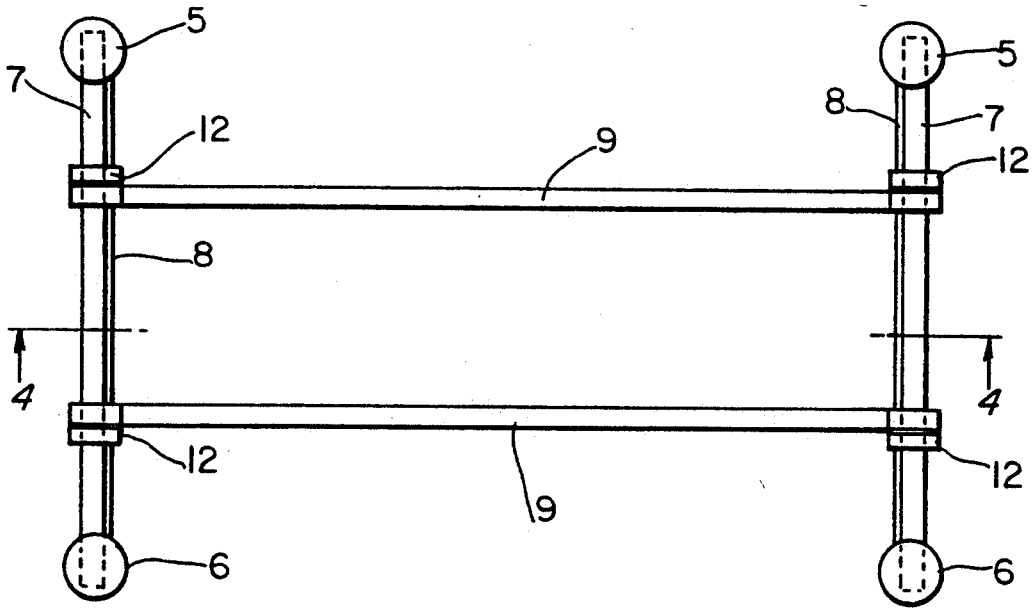
Figure 6:
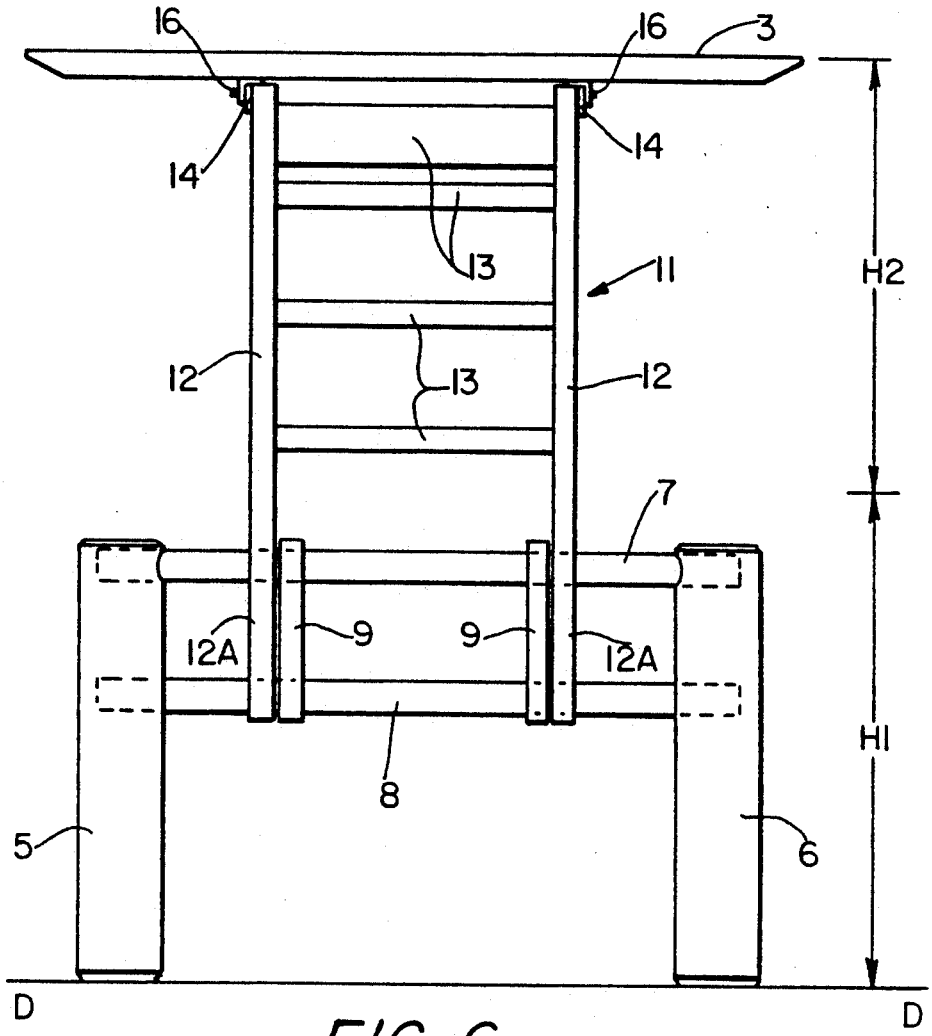
Figure 12:
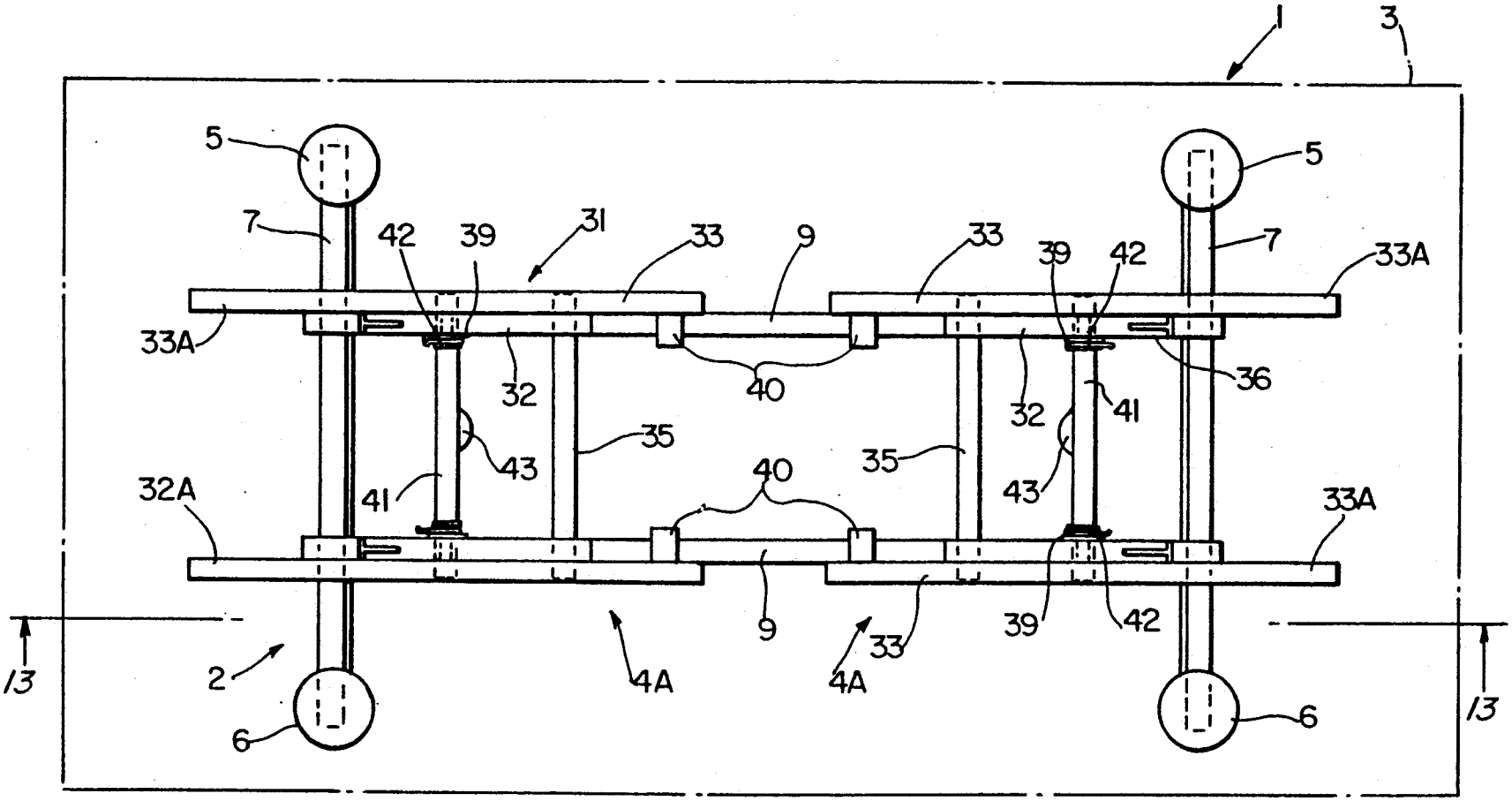
Figure 13:
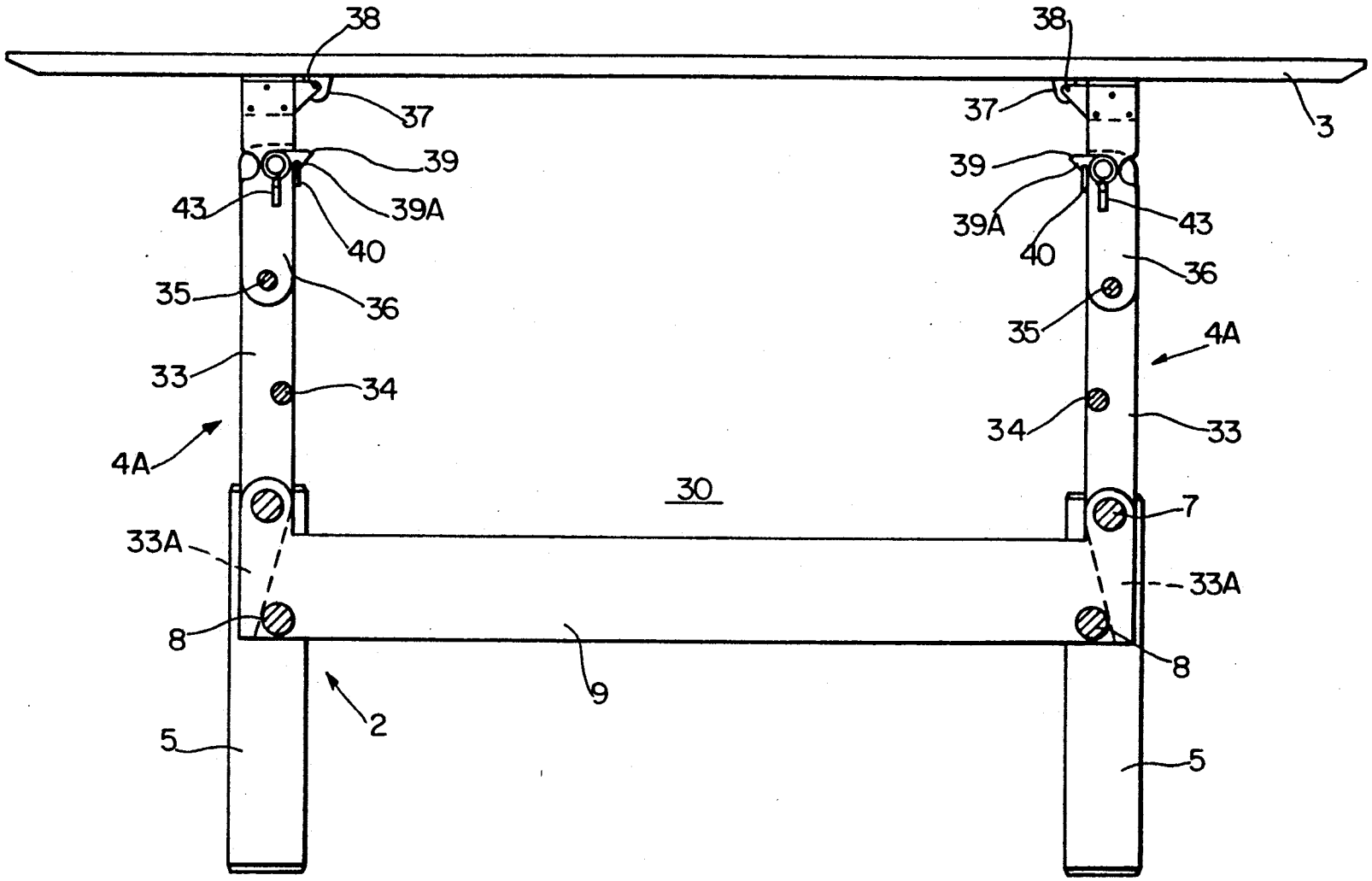

FIGS. 12 and 13 show a further embodiment and correspond to FIGS. 2 and 4 of the first embodiment.

Referring to FIGS. 1-6, a dual-mode table 1 has a first mode (FIG. 1) as a coffee table and a second mode (FIG. 4) as a dining table. The table 1 generally comprises a legged base structure 2, a work top 3 and extension means 4 located between the base structure 2 and the work top 3 whereby the top 3 can be set at the relatively lower position of FIG. 1 or at the relatively higher position of FIG. 4. In particular, the table top height (Ha) in FIG. 1 can be the norm for coffee tables, say about 15 ins (38 cm) while in FIG. 4 the top height (H1+H2) will be suitable for dining purposes, say about 29 ins (73.5 cm).

The base structure 2 comprises two pairs of legs 5, 6 (FIG. 2), upper and lower cross bars 7, 8 of circular cross section joining the legs 5, 6 of each leg pair and longitudinal frame members 9 linking the bars 7, 8 of each leg pair, each member 9 including an upwardly facing recess 10.

Each extension means 4 comprises a one-piece (i.e. unarticulated) frame 11 of ladder form with side bars 12 and cross members 13, each frame 11 being pivotally mounted on a respective cross-bar 7. The inner ends of the frame 11 (FIG. 1) are slidably coupled to the work top 3 by means of pin members 14 engaging in slots 15 in longitudinal plates 16 (of angle form) attached to the underside of the work top 3. Each slot 15 includes an axial portion 15A which cooperates with the pin member 14 of the associated frame 11 for raising the work top 3 when the frame 11 is swung upwardly while, to assist retainment of the work top 3 in the raised position, to outer end of each slot 15 has a portion 15B which extends laterally to the portion 15A and curves backwardly to receive the pin member 14 in a locked condition. The side bars 12 of the frame 11 included tail portions 12A which abut against the bars 8, when the extension means 4 are swung to the raised position, to set the frames 11 in the upright position (FIG. 4) with the work top 3 raised. In the lowered position, the angle form plates 16 on the work top 3 rest against the cross bar 7 of the base structure 2 so that the work top 3 is substantially at the level of the top of the base structure 2.

Figure 7A:
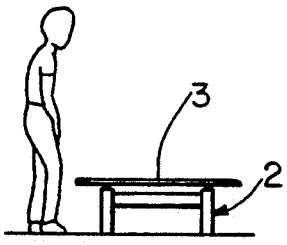
Figure 7B:
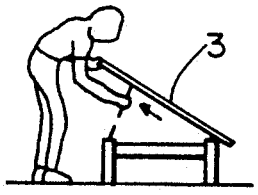
Figure 7C:
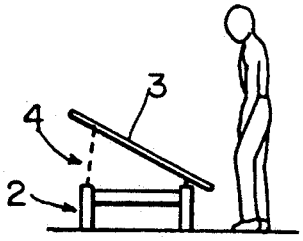
Figure 7D:
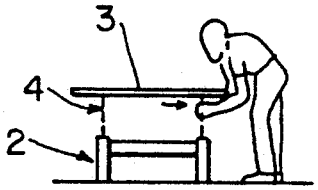
Figure 7E:
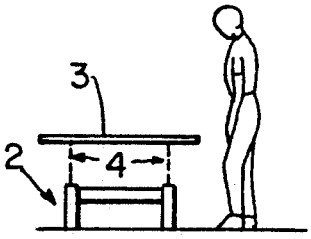

The work top 3 is moved from a low setting where the top 3 is at a high H1 above a floor datum D—D through a height H2 to the high setting. The extension means 4 enable movement of the work top 4 between the settings to the simple and straightforward. Thus, referring to FIGS. 7(*a*)-7(*e*), to move the top 3 to the elevated (dining) setting, one of the frames 11 is swung upwardly (FIG. 7*b*) to the raised condition so that the associated pin member 14 is locked in slot-portion 15B, then a similar operation is carried out on the other frame 11 (FIG. 7*d, e*). Lowering of the table top 3 is simply the reverse of these operations, slight pressure firstly being applied to free the pin member 14 from the locked condition in the slot portions 15B. The extension means 4 enable the raised height H2 of the table top 3 to be at least 0.75 H1 and even greater so that the top 3 can be set relatively low for the first mode (i.e. as a coffee table) but nevertheless be set substantially high for the second mode (i.e. in the dining table mode).

Figure 8:
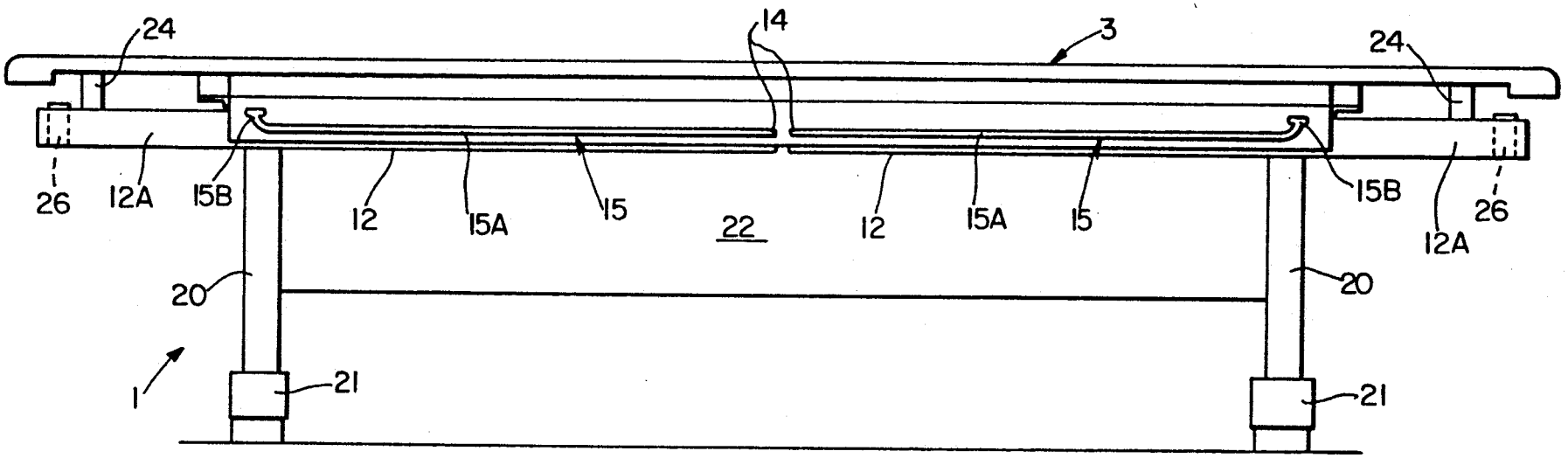
Figure 9:
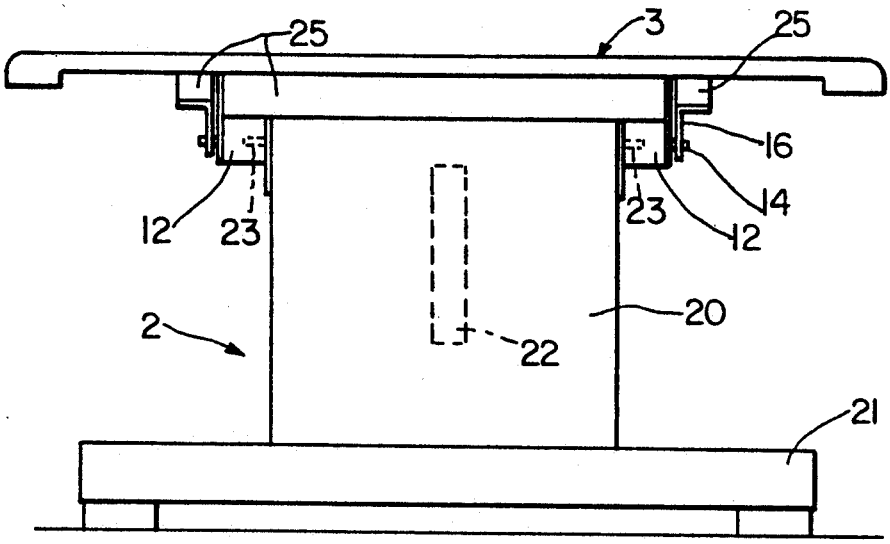
Figure 11:
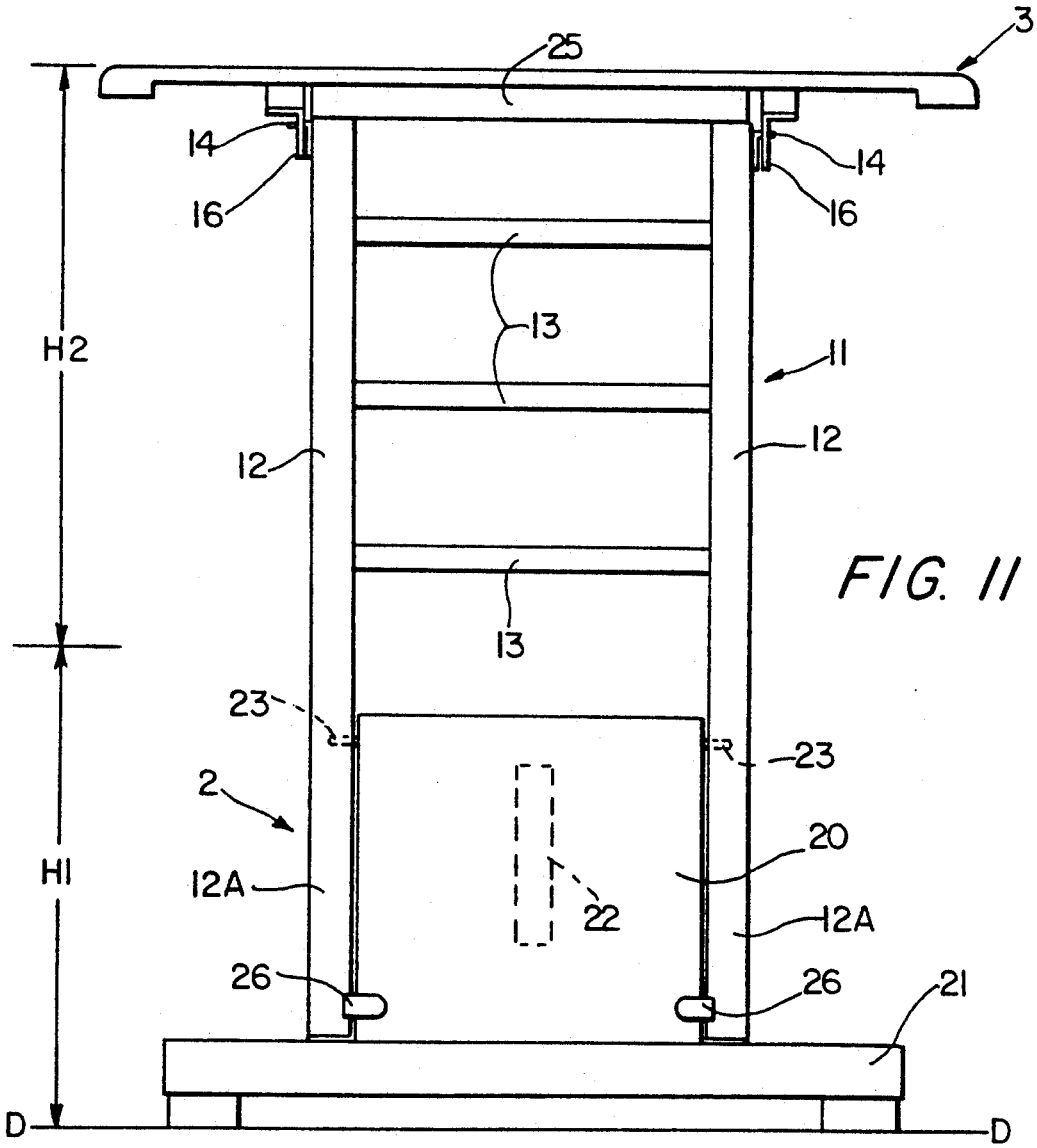
Figure 10:
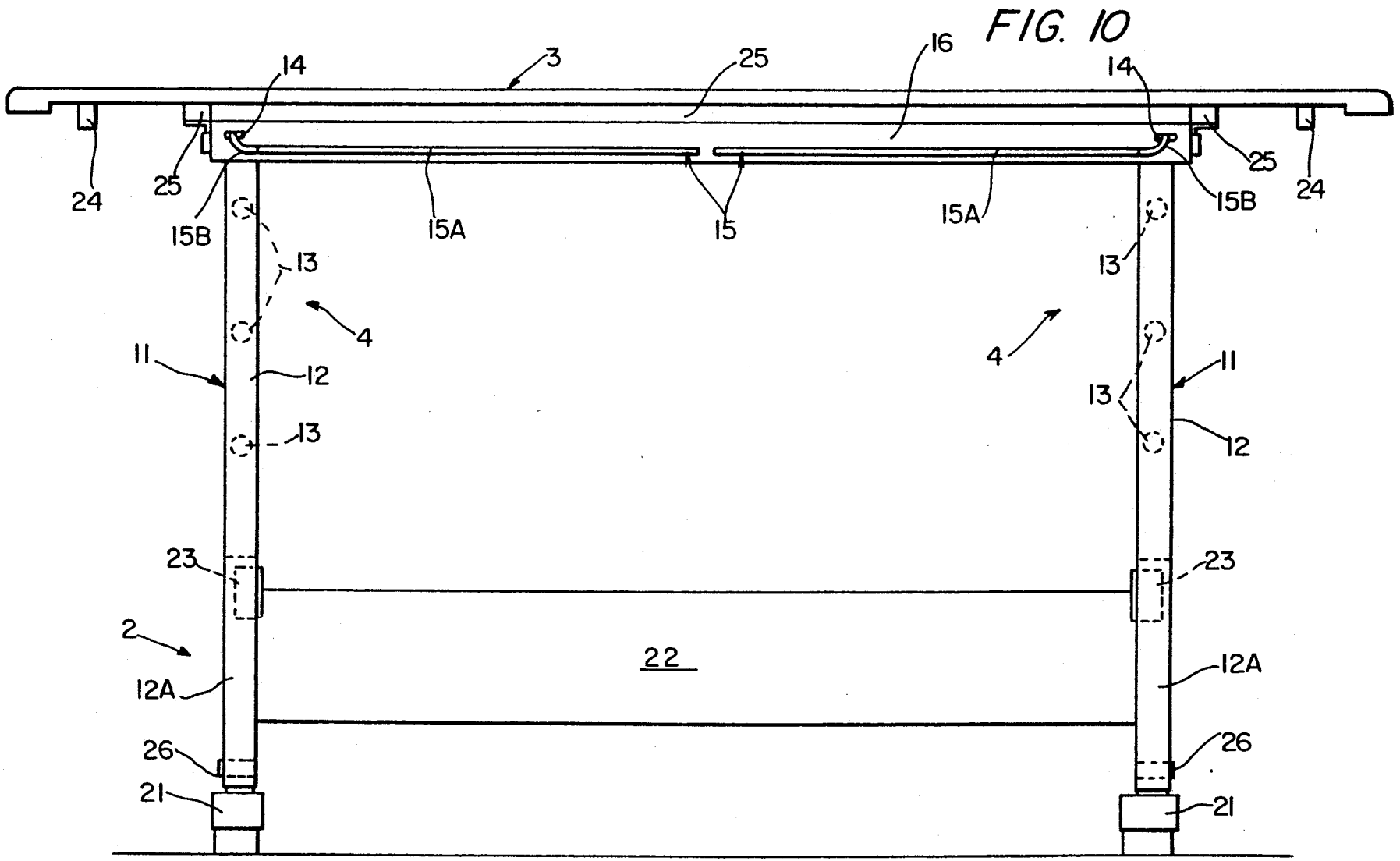

The embodiment shown in FIGS. 8 to 11 has similarly to the first embodiment, the extension means 4 being essentially the same, but the base structure 2 of this embodiment is somewhat different. For convenience like parts to the first embodiment carry similar reference numerals. In this embodiment, the base structure 2 has end uprights 20 of solid form mounted on base support 21, and a single central beam 22 of rectangular cross-section joins the uprights 20. The use of this single beam 22 gives improved leg room when the table top 3 is in the raised dining mode (FIG. 10). The frames 11 are pivotally coupled to the uprights 20 via pins 23 while the tail portions 12A of the frames 11 abut against buffers 24 in the lower surface of table top 3 in the top lowered condition (FIG. 8). The lower surface of the top 3 also carries a rib structure 25 to which the slot-plates 16 are attached, and lugs 26 on the tail portions 12A abut against the uprights 20 in the raised condition (FIG. 11) to stabilise the extension means 4.

The embodiment of FIGS. 8–11 is set in exactly the same manner as shown in FIGS. 7(*a*)–(*e*).

The embodiment shown in FIGS. 12 and 13 has a similar base structure to that of the first embodiment but in this case each extension means is in the form of a accordion frame device 4A.

Each accordion frame device 4A comprises a double-frame set 31. 32. A first frame 31 of the set includes longitudinal members 33 journalled to a respectively cross-bar 7 of the base structure 2 and cross bar 34, 35 between the members 33, the members 33 lying to the outside of the frame members 9, while the second frame 32 of the set has longitudinal members 36 which lie in respective recesses 30 in the lowered position and which are swingably coupled at one end to a transverse rib 37 of the table top 3 by the pins 38. The top edge of each frame device 4A is offset from the pins 38 so that when the top edge is in engagement with the table top 3 (FIG. 13) the table top 3 and the frame device 4A are precluded from adopting an obtuse angle. Further the members 36 are journalled at the other end to the cross bar 35 of frame 31 to provide the accordion swinging action of the frames 31, 32 the members 36 being recessed to allow the bar 34 to nest in the members 36 in the closed condition. The members 33 include tail portions 33A which press against the lower cross bars 8 of the base structure 2 to stabilize the accordion device 4A when the devices 4A are in the open extended condition (FIG. 13).

To enable the accordion devices 4A to be locked automatically in the open extended condition, locking cams 39 are provided on the frames 32 which co-operate with locking plates 40 in the frames 31. The cams 39 are secured to a cross bar 41 rotatably carried by the members 36, the cams 39 being urged into the locking position by coil springs 42 on the bar 41, and each cam 39 includes an inclined nose portion 39A whereby the cam 39 can be swung back by the plate 40 to enable the plate 40 to lock automatically in the recess of the cam. In the closed position, the plates 40 abut against members 9 to limit the swinging movement of the frame 31. A manual release knob 43 is carried by the bar 41.

Movement of the table top 3 between the low and high settings is again essential by the procedure shown in FIGS. 7(*a*)–7(*e*).

The table 1 in each embodiment may be made essentially of wood, but other material could be utilised—for example various cross bars of metal e.g. tubs. The plates 16 are preferably of metal. It would be possible to have a design where the base structure 2 and the extension means 4 are essentially of tubular metal form. The legs 5, 6 are shown as having a circular cross-section but a rectangular cross-section is of course possible.

While the above dual mode table 1 or each above embodiment is defined for coffee table/dining tables modes the present invention could be applied in a piece of furniture for other dual modes e.g. couch/work bench.

We claim:

1. A variable height table, comprising:

a fixed base structure having a top;

a work top;

a pair of extension members positioned between said base structure and said work top, each of said extension members comprising swingable support means for moving said work top from a first position substantially level with said top of said base structure at a first height above said support surface to a second position wherein said work top is set at an increased height above said first position, each of said support means having a lowered position in which said work top is in said first position and an extended position in which said work top is in said second position, each of said support means comprising a lever pivotable about a pivot axis, said lever having two arms extending in opposite directions from said pivot axis, one arm of each said lever comprising a tail, each said tail defining stabilizing means for stabilizing each of said extension members when said work top is in said second position, the other arm of said lever being coupled to said work top and said tails firmly engaging said base structure at points spaced from said pivot axis when said support means are in said extended position;

pivot means for pivotally connecting each of said support means to said base structure at said pivot axis; and releasable lock means for locking said support means in said extended position.

2. The variable height table of claim 1, wherein each of said extension members and said work top include surface positions which abut to limit relative pivoting movement between said extension members and said work top.

3. The variable height table of claim 1, wherein said increased height is at least three quarters of said first height.

4. The variable height table of claim 1, wherein said work top rests on said base structure in said first position.

5. The variable height table of claim 1, wherein each of said support means has a first end and a second end, said support means adjacent said first end being pivotally attached to said base structure; and wherein said variable height table further comprises coupling means for slidably coupling said second end of said support means to said work top, whereby said support means can be swung from said lowered position to said extended position.

6. The variable height table of claim 5, wherein said coupling means comprises a pin and slot arrangement.

7. The variable height table of claim 6, wherein said slot of said pin and slot arrangement comprises a first axis portion which cooperates with said pin to raise said work top when said support means are swung towards said extended position, and an end slot portion operating to lock said support means in said extended position.

8. The variable height table of claim 7, wherein said end slot portion curves backwardly.

9. The variable height table of claim 1, wherein said lock means comprises spring-urged lever means for locking said support means automatically in said extended position.

10. The variable height table of claim 9, wherein said lever means is positioned adjacent to said work top when said support means are in said extended position.

11. The variable height table of claim 1, wherein said support means are positioned opposite each other when in said lowered position.

12. The variable height table of claim 1, wherein said base structure comprises end uprights and at least one longitudinal member joining said end uprights, and wherein said work top is substantially rectangular.

13. The variable height table of claim 12, wherein said base structure includes a central longitudinal member joining said end uprights.

14. The variable height able according to claim 1, wherein said work top has an underside, and wherein said variable height table further comprises:

a pair of accordion devices, each accordion device comprising a longitudinal member on one of said pair of extension members, each said longitudinal member having a first end and a second end and being pivotally connected to its respective extension member at said first end and connected to said underside of said work top at said second end, each said longitudinal member being collapsible in a accordion fashion to lower said work top from said second position, in which said work top is set at an increased height above said first position, to a third position intermediate in height between said first and second positions; and means for releasably locking said longitudinal members in either a first or a second position.

15. The variable height table of claim 14, wherein said locking means comprises a spring-urged lever means for locking said support means automatically in said extended position.

16. The variable height table of claim 15, wherein said lever means is positioned adjacent said work top when said support means is in said extended position.

* * * * *